US010966514B2

(12) United States Patent
Goldberg et al.

(10) Patent No.: US 10,966,514 B2
(45) Date of Patent: Apr. 6, 2021

(54) CLEANSING BRUSHHEAD FOR A FACIAL SKIN CLEANSING APPLIANCE

(71) Applicant: L'OREAL, Paris (FR)

(72) Inventors: Samuel Benjamin Goldberg, Seattle, WA (US); Kyle Yeates, Redmond, WA (US)

(73) Assignee: L'Oreál SA, Paris (FR)

( * ) Notice: Subject to any disclaimer, the term of this patent is extended or adjusted under 35 U.S.C. 154(b) by 0 days.

(21) Appl. No.: 16/541,935

(22) Filed: Aug. 15, 2019

(65) Prior Publication Data

US 2021/0045521 A1 Feb. 18, 2021

(51) Int. Cl.

| | |
|---|---|
| ***A46B 13/02*** | (2006.01) |
| ***A46B 9/06*** | (2006.01) |
| ***A46B 9/02*** | (2006.01) |
| ***A46B 13/00*** | (2006.01) |

(52) U.S. Cl.

CPC ..... *A46B 13/02* (2013.01); *A46B 9/02* (2013.01); *A46B 9/06* (2013.01); *A46B 13/008* (2013.01); *A46B 2200/1006* (2013.01)

(58) Field of Classification Search

CPC .. A46B 13/02; A46B 9/02; A46B 9/06; A46B 13/008; A46B 2200/1006

USPC ..... 15/28

See application file for complete search history.

(56) References Cited

U.S. PATENT DOCUMENTS

| | | | | |
|---|---|---|---|---|
| 4,343,265 | A * | 8/1982 | Belschner | A01K 13/002 119/625 |
| 7,386,906 | B2 * | 6/2008 | Roth | A46B 13/06 15/28 |
| 7,786,626 | B2 * | 8/2010 | Reishus | A46B 13/02 310/36 |
| 8,641,702 | B2 * | 2/2014 | Pilcher | A61N 5/0616 606/9 |
| 9,107,486 | B2 * | 8/2015 | Brewer | A46B 13/02 |
| 9,474,358 | B2 * | 10/2016 | Brewer | A46B 9/021 |
| D778,065 | S * | 2/2017 | Kern | A46B 13/008 D4/127 |
| D782,197 | S * | 3/2017 | Kern | D4/127 |
| 10,080,428 | B2 * | 9/2018 | Kern | A47K 7/043 |
| 10,264,927 | B2 * | 4/2019 | Brewer | A47K 7/043 |
| D869,674 | S * | 12/2019 | Cheng | D24/214 |
| D871,770 | S * | 1/2020 | Diener | D4/102 |
| D871,771 | S * | 1/2020 | Diener | D4/102 |
| 10,531,729 | B1 * | 1/2020 | Liu | A46B 5/0095 |
| D884,355 | S * | 5/2020 | Diener | D4/102 |
| 10,736,413 | B2 * | 8/2020 | Brewer | A46B 13/023 |

(Continued)

FOREIGN PATENT DOCUMENTS

| | | | | |
|---|---|---|---|---|
| DE | 102007007615 A1 * | 8/2008 | | A61K 8/68 |
| DE | 102008052824 A1 * | 4/2010 | | A46B 7/04 |
| WO | WO-0156529 A2 * | 8/2001 | | A46B 13/02 |

*Primary Examiner* — Marc Carlson

(74) *Attorney, Agent, or Firm* — Clark A. Puntigam; Jensen & Puntigam, P.S.

(57) ABSTRACT

The brushhead includes an outer brushhead which is fixed in operation when the brushhead is attached to a skin brush appliance and an inner brushhead which oscillates in operation. The outer brushhead includes three spaced sections of elastomeric fingers and three spaced sections of tufts positioned, respectively, between the elastomeric finger sections. The inner brushhead includes a plurality of non-circular concentric rows of tufts.

10 Claims, 3 Drawing Sheets

(56) References Cited

U.S. PATENT DOCUMENTS

| | | | | |
|---|---|---|---|---|
| 2005/0277950 | A1* | 12/2005 | Pilcher | A61B 17/54 606/131 |
| 2007/0142845 | A1* | 6/2007 | Akridge | A61B 17/50 606/131 |
| 2009/0318853 | A1* | 12/2009 | Reed | A61M 37/0092 604/22 |
| 2010/0262051 | A1* | 10/2010 | De Laforcade | A61H 7/005 601/84 |
| 2014/0309662 | A1* | 10/2014 | Brewer | A46B 9/028 606/131 |
| 2016/0045081 | A1* | 2/2016 | Kern | A46B 13/02 15/22.4 |
| 2016/0183670 | A1* | 6/2016 | Brewer | A46B 15/0006 15/22.1 |
| 2016/0367086 | A1* | 12/2016 | Brewer | A46B 13/02 |
| 2017/0119144 | A1* | 5/2017 | Brewer | A46B 13/008 |
| 2017/0372634 | A1* | 12/2017 | Straka | A46B 13/001 |
| 2018/0098615 | A1* | 4/2018 | George | A61Q 5/02 |
| 2019/0029411 | A1* | 1/2019 | Brewer | A61H 7/005 |

* cited by examiner

CLEANSING BRUSHHEAD FOR A FACIAL SKIN CLEANSING APPLIANCE

TECHNICAL FIELD

This invention relates generally to skin cleansing brushheads for use with a power skin cleaning appliance and more particularly concerns such a brushhead with improved skin cleansing characteristics having a fixed outer brush portion and an oscillating inner brush portion.

BACKGROUND

Effective and efficient skin cleansing is important for facial skin health. A wide variety of appliances and brushhead configurations are known which collectively have advantages as well as disadvantages. An important consideration in effective skin cleansing with a power appliance is not only effective cleansing and the overall cleansing experience for the user, but also an effective and efficient flow of cleansing fluid to the active portion of the brushhead and the efficiency of fluid flow with residue away from the active portion of the brushhead. The brushhead disclosed herein has the characteristics of convenience and effectiveness in allowing fluid to flow to the active portion of the brushhead and then away therefrom during operation.

SUMMARY

This portion of the application will be completed when it is prepared in final form.

BEST MODE FOR CARRYING OUT THE INVENTION

Figure 1:
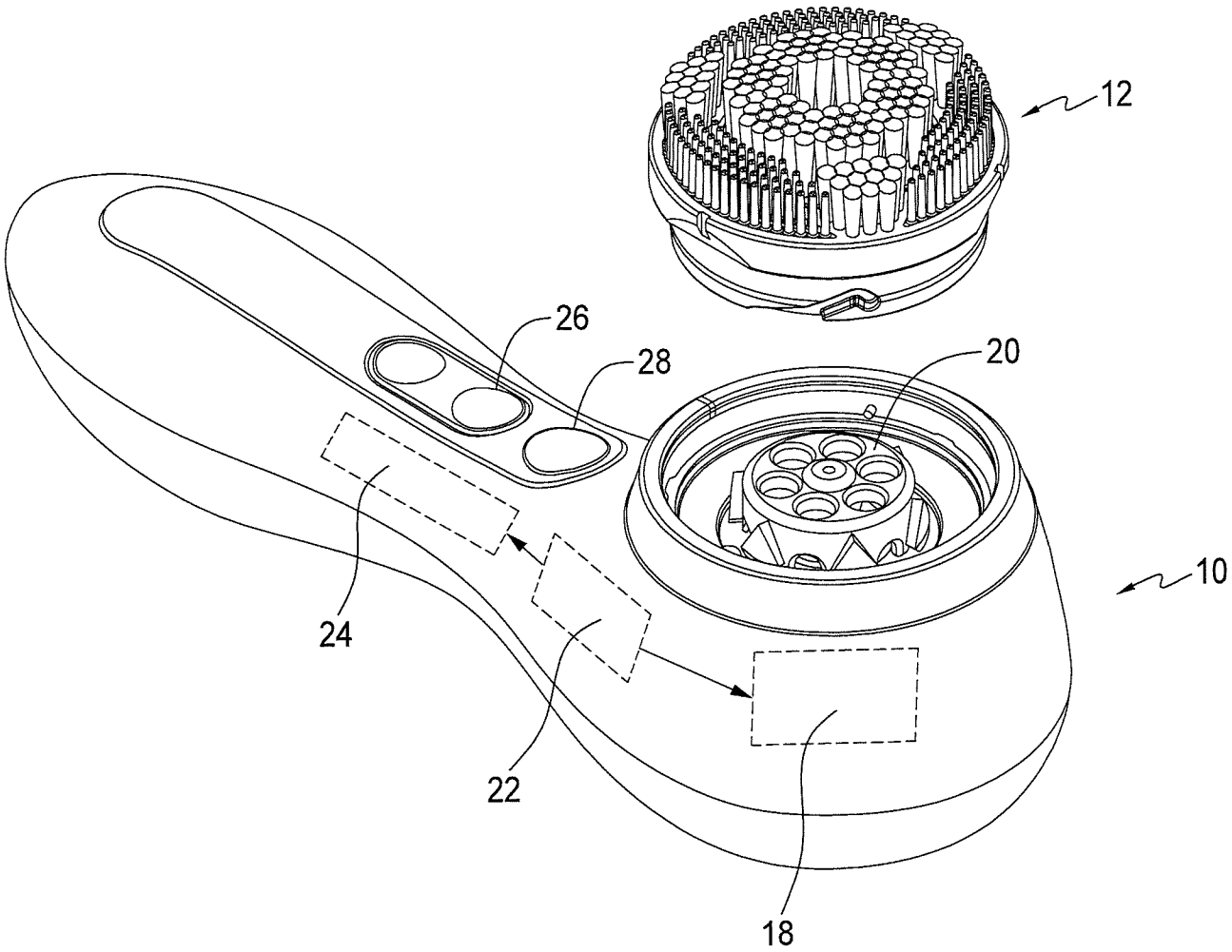
FIG. 1 schematic view of a power appliance, with a brushhead of the present invention exploded away therefrom.

FIG. 1 shows in general a power skin brush appliance 10 and the brushhead of the present invention at 12. The appliance 10 is well known and hence is not described in detail. One commercial example is a Clarisonic skin brush appliance manufactured and sold by L'Oréal. The appliance can include a number of control features, but for illustration the appliance shown includes a motor 18 which operates on a drive member 20 to which the brushhead 12 is removably attachable. The motor 18 is powered by a rechargeable battery 22 and controlled by a microprocessor 24. The processor can be programmed to provide various frequencies and amplitudes for movement of the brushhead in an oscillatory manner. One particular combination is useful to drive the brushhead in a manner described in more detail below. The appliance 10 illustration includes an on/off switch 26 for control of the appliance and another button 28 for various operations such as for instance control of power application. These controls are for illustration only and can be varied as desired for particular applications.

Figure 2:
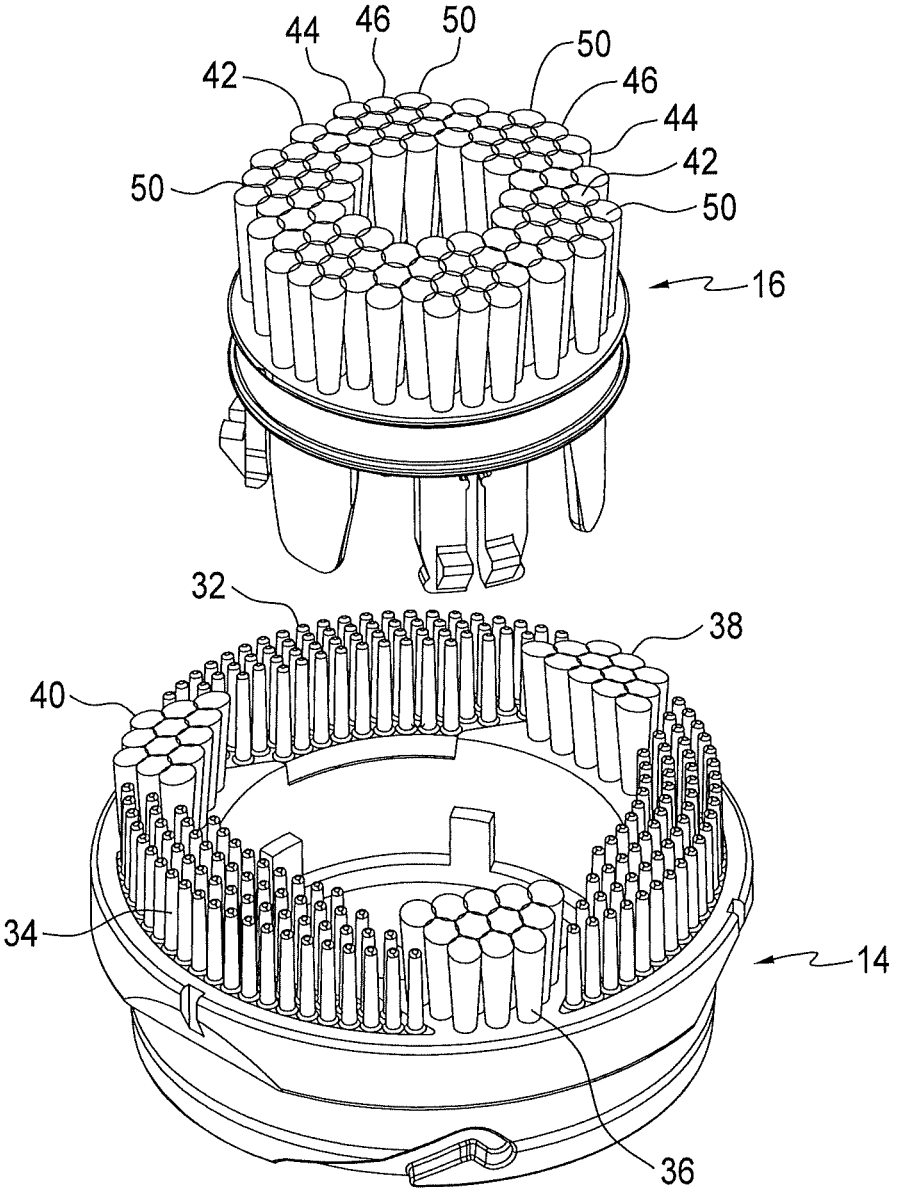
FIG. 2 is an exploded view of the brushhead of FIG. 1.
Figure 3:
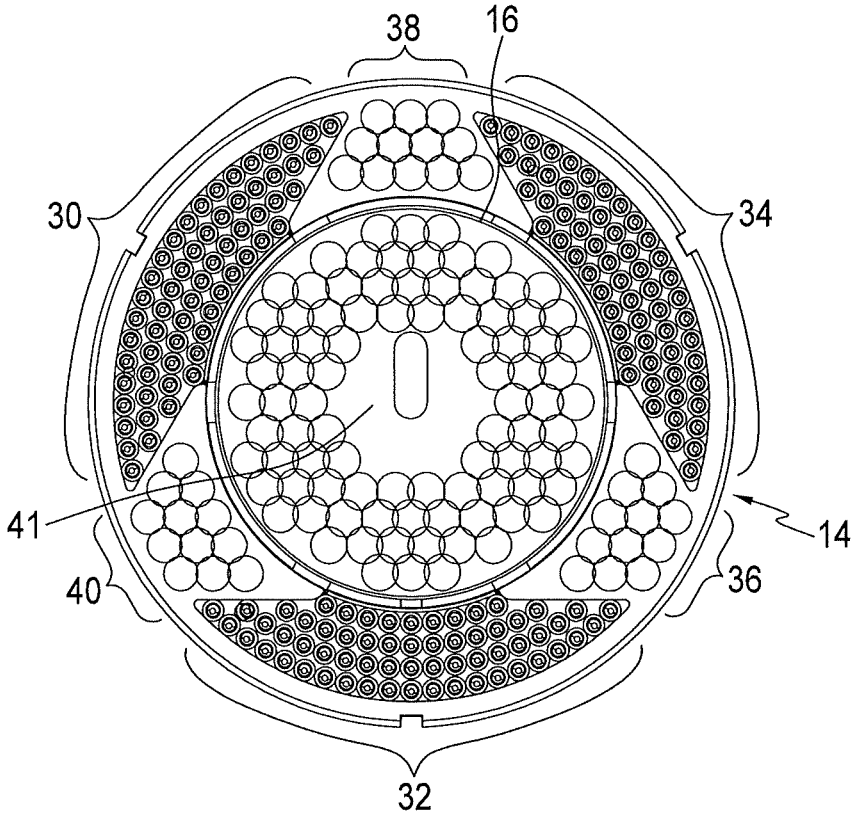
FIG. 3 is a top view of the brushhead of FIG. 1.

Referring now to FIGS. 2 and 3 in detail, the brushhead 12 includes an outer brushhead portion 14 and an inner brushhead portion 16. The outer brushhead portion in the embodiment shown is fixed in position when the brushhead is attached to the appliance. It does not move in operation. In the embodiment shown, the outer brushhead portion includes three spaced curved sections 30, 32, 34 of elastomeric fingers around the circumference of the brushhead, the sections being equal in size as shown, although the size of the separate sections may vary to some extent. Positioned between the three finger sections are three sections 36, 38, 40 of elastomeric or non-elastomeric tufts such as nylon tufts. In the embodiment shown, the elastomeric finger sections comprise 2-5 rows of fingers, and preferably, in the embodiment shown, four concentric rows. The outer row has a circumferential angle of 85.6 degrees. The next row is 76.9 degrees. The next row is 62.7 degrees and the inner row is 45.8 degrees. Preferably, the dimensions of the fingers are 1.2 mm in diameter and 8-12 mm high. In the embodiment shown, the outer row of fingers in each section includes 21 fingers, the next row includes 17 fingers, the next row includes 13 fingers and the inner row includes 9 fingers. It should be understood, however, that the circumferential angle of the fingers and the number of fingers in each row can vary.

Each tuft section in the outer brushhead portion in the embodiment shown comprises 2-4 rows of tufts, preferably three rows gathered in a honeycomb tuft configuration or arrangement, as shown. The tufts are each approximately 1.5 mm in diameter, each comprising a group of filaments approximately 0.0003 inches in diameter. In the embodiment shown, for illustration, the tuft sections include an outer row of 3 tufts, a middle row of 4 tufts and an inner row of 5 tufts, although the number of tufts in the rows can vary. The tuft sections are arranged to fit between adjacent finger sections with a small gap between each tuft section and the adjacent finger sections. This arrangement results in a recognizable, distinctive feel for the user as it operates with the inner brushhead oscillating, as discussed below.

Figure 4:
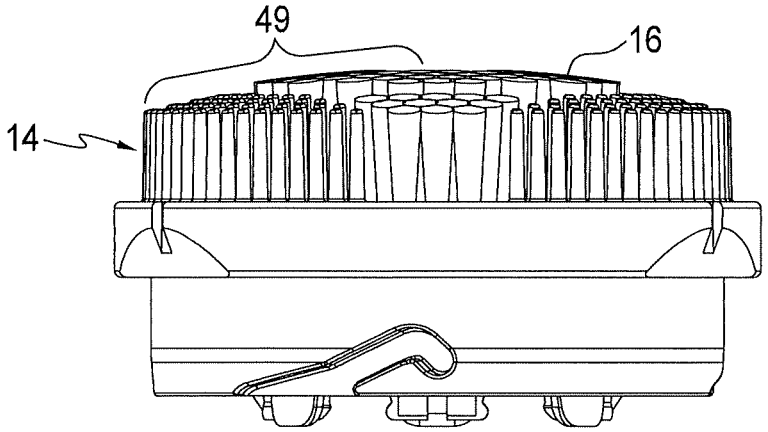
FIG. 4 is an elevational view of the brushhead of FIG. 1.

The inner brushhead portion 16 includes a plurality of non-circular concentric rows of elastomeric tufts, surrounding a central opening 41, which in the embodiment shown is approximately 11 mm in diameter. In the embodiment shown, the non-circular concentric rows are hexagonal, comprising between two and four rows, preferably three rows, shown at 42, 44 and 46 in FIG. 2. Other non-circular arrangements can be used including 3, 4 and 5 sided arrangements, and 7 and 8 sided arrangements, for example. The rows 42, 44, 46 are continuous, i.e. not interrupted. In addition, the embodiment shown includes one interrupted outer row 50 of six equally spaced sections of three tufts each, although again this number can be varied. The diameter of the bristles are 0.003-0.005 inch. The height of the tufts will vary, in particular, the height of the tufts will decrease from the inner row of tufts in the inner brushhead portion to the outer row of tufts in the inner brushhead portion. In the embodiment shown, the decrease in height has a radius of 100-200 mm. The decrease in height continues for the height of the fingers in the outer brushhead as well. This is shown at 49 in FIG. 4. This non-uniform height, defining a curved profile, helps to produce a deep pore cleansing effect capable of reaching hard to access areas of the face, such as in the crevices by the nose.

The tufts of the inner brushhead portion rows are arranged and have dimensions to define a differential stiffness between them, such that the tufts in the separate rows move in opposing directions as the inner brushhead portion oscillates, referred to as a counter rotating effect, which is described in more detail in U.S. Pat. No. 8,484,788. The counter rotation effect, as the bristles in the individual rows move in opposing directions, increases the cleansing effect.

The opening 41 in the inner brushhead portion permits the placement of a time indicator which in one arrangement is an oil indicator element in which oil diffuses through a porous membrane when the brushhead is placed on the appliance. The oil indicator includes a visible portion which indicates to the user when the usual life of the brush is completed.

The brushhead disclosed herein provides an improved cleaning experience for the user because of the particular arrangements of the outer brushhead and the inner brushhead. The sections of the outer brush provide a different feel or experience on the face of the user due to the arrangement of the spaced sections of elastomeric fingers and tufts, and the difference in material. The several finger sections being physically separated from one another around the circumference of the brushhead provides the user a particular sensation during the cleaning experience unavailable with other brush arrangements.

The particular arrangement of the fixed outer brush with its spaced regions of elastomeric fingers and tufts allows fluid, including water, to flow to the inner brush portion which serves as the active elements for the skin brush, and also permits the fluid to easily flow away from the inner brushhead portion. The result is that a cleaning fluid, including water, can easily get to the region of the face where it is needed and the resulting fluid with particulates from the cleansing are not trapped within the inner brushhead portion, but flow outwardly as the brushhead is moved across the face.

Although a preferred embodiment of the invention has been disclosed for purposes of illustration, it should be understood that various changes, modifications and substitutions may be incorporated in the embodiment without departing from the spirit from the invention, which is defined by the claims which follow.

What is claimed is:

1. A cleansing brushhead for use with a skin cleansing appliance, comprising:

an outer brushhead base member, attachable to a handle of the skin cleansing appliance, wherein the outer brushhead base member remains fixed in position during operation of the appliance;

an outer brushhead mounted on the outer brushhead base member, the outer brushhead including at least two spaced sections each comprising a plurality of rows of elastomeric fingers and at least two sections of tufts positioned, respectively, between the spaced sections of elastomeric fingers, wherein each section of tufts comprises a plurality of rows of tufts having a honeycomb arrangement; and an inner brushhead mounted on an inner brushhead base member, which oscillates in operation by the appliance, the inner brushhead including a plurality of non-circular rows of tufts, wherein the non-circular rows of tufts are hexagonal.

2. The cleansing brushhead of claim 1, wherein the heights of the tufts in the inner brushhead and the elastomeric fingers and tufts in the outer brushhead decrease from a center of the cleansing brushhead to a surrounding outer edge thereof, defining a curved surface with a radius of between 100-200 mm.

3. The brushhead of claim 1, wherein the outer brushhead includes three sections of elastomeric fingers and three sections of tufts, the elastomeric fingers extending around the circumference of the outer brushhead for a distance which is greater than the distance of the tufts.

4. The brushhead of claim 3, wherein the elastomeric finger sections are equally spaced and have the same distance around the brushhead.

5. The brushhead of claim 1, wherein the dimensions of the rows of the tufts of the inner brushhead are selected to have a differential stiffness resulting in an opposing movement of the tufts in operation.

6. The brushhead of claim 1, wherein the inner brushhead includes three rows of tufts having a honeycomb configuration and an outer segmented row of three equally spaced tuft sections.

7. The brushhead of claim 6, wherein each outer segmented row tuft section comprises three tufts.

8. The brushhead of claim 1, wherein in operation, the inner brushhead portion oscillates at a frequency of 160-180 Hz and an amplitude of 6-12°.

9. The brushhead of claim 1, wherein the diameter of the elastomeric fingers in the outer brushhead is 1.2 mm and the diameter of the tufts in the outer brushhead is approximately 1.5 mm.

10. The brushhead of claim 1, wherein the diameter of the tufts in the inner brushhead is approximately 1.5 mm.

* * * * *